US006752491B2

(12) United States Patent
Waggoner et al.

(10) Patent No.: US 6,752,491 B2
(45) Date of Patent: Jun. 22, 2004

(54) INKJET PRINTING SYSTEM HAVING EXTENDED HEATER RESISTOR LIFE

(75) Inventors: Karen Wytmans Waggoner, Carlsbad, CA (US); John M Wade, Poway, CA (US); Paul Crivelli, San Diego, CA (US); Kan Liu, San Diego, CA (US); Grant Allen Webster, Valley Center, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/229,332

(22) Filed: Aug. 26, 2002

(65) Prior Publication Data

US 2003/0076388 A1 Apr. 24, 2003

Related U.S. Application Data

(63) Continuation of application No. 09/793,203, filed on Feb. 23, 2001, now abandoned.

(51) Int. Cl.[7] ..... B41J 2/175

(52) U.S. Cl. ..... 347/85

(58) Field of Search ..... 347/84, 85, 86, 347/87

(56) References Cited

U.S. PATENT DOCUMENTS

| | | | | |
|---|---|---|---|---|
| 5,278,584 | A | 1/1994 | Keefe et al. | |
| 5,691,753 | A | 11/1997 | Hilton | |
| 6,003,981 | A | 12/1999 | Cameron et al. | |
| 6,547,377 | B2 * | 4/2003 | Thielman et al. | 347/85 |

FOREIGN PATENT DOCUMENTS

| | | |
|---|---|---|
| EP | 0927638 A2 | 7/1999 |
| EP | 0965451 A2 | 12/1999 |

* cited by examiner

*Primary Examiner*—Anh T. N. Vo

(57) ABSTRACT

An ink jet printer having an ink delivery system that allows air to be absorbed by ink that is being delivered to an ink jet print cartridge that includes a thermal printhead, so that ink delivered to the printhead has an air saturation level of at least 30%. The dissolved air reduces damage to heater resistors of the thermal ink jet printhead that would otherwise be caused by the in rush of ink after an ink drop is fired.

53 Claims, 4 Drawing Sheets

INKJET PRINTING SYSTEM HAVING EXTENDED HEATER RESISTOR LIFE

CROSS REFERENCE TO RELATED APPLICATION(S)

This is a continuation of application Ser. No. 09/793,203 filed on Feb. 23, 2001 now abandoned, which is hereby incorporated by reference herein.

BACKGROUND OF THE INVENTION

The disclosed invention relates to ink jet printing systems, and more particularly to increasing the usable life of ink firing heater resistors.

Ink jet printing systems commonly make use of an ink jet printhead that is moved relative to a print medium such as paper. As the printhead is moved relative to the print medium, control electronics activate an ink drop generator portion of the printhead to eject or fire ink droplets from ejector nozzles and onto the print medium to form a printed image. An ink supply provides ink for the printhead.

Some ink jet printing systems employ an ink supply that is replaceable separately from the printhead. When such "off-axis" ink supply is exhausted, the ink supply (e.g., an ink cartridge) is removed and replaced with a new ink supply. The printhead is replaced at or near the end of the printhead life, and not when the ink supply is exhausted. When a replaceable printhead is capable of utilizing a plurality of ink supplies, this can be referred to as a "semipermanent" printhead, which is in contrast to a disposable printhead that is replaced with when the ink supply is replaced.

A consideration with semipermanent printheads is a desire for extended heater resistor life so that the printhead is replaced less frequently.

SUMMARY OF THE INVENTION

The disclosed invention is directed to an ink delivery system that allows air to be absorbed by ink that is being delivered to a thermal ink jet printhead so that ink delivered to the printhead has an air saturation of at least 30%. Alternatively, the ink delivered to the thermal ink jet printhead has an air saturation of at least 50% or 70%.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
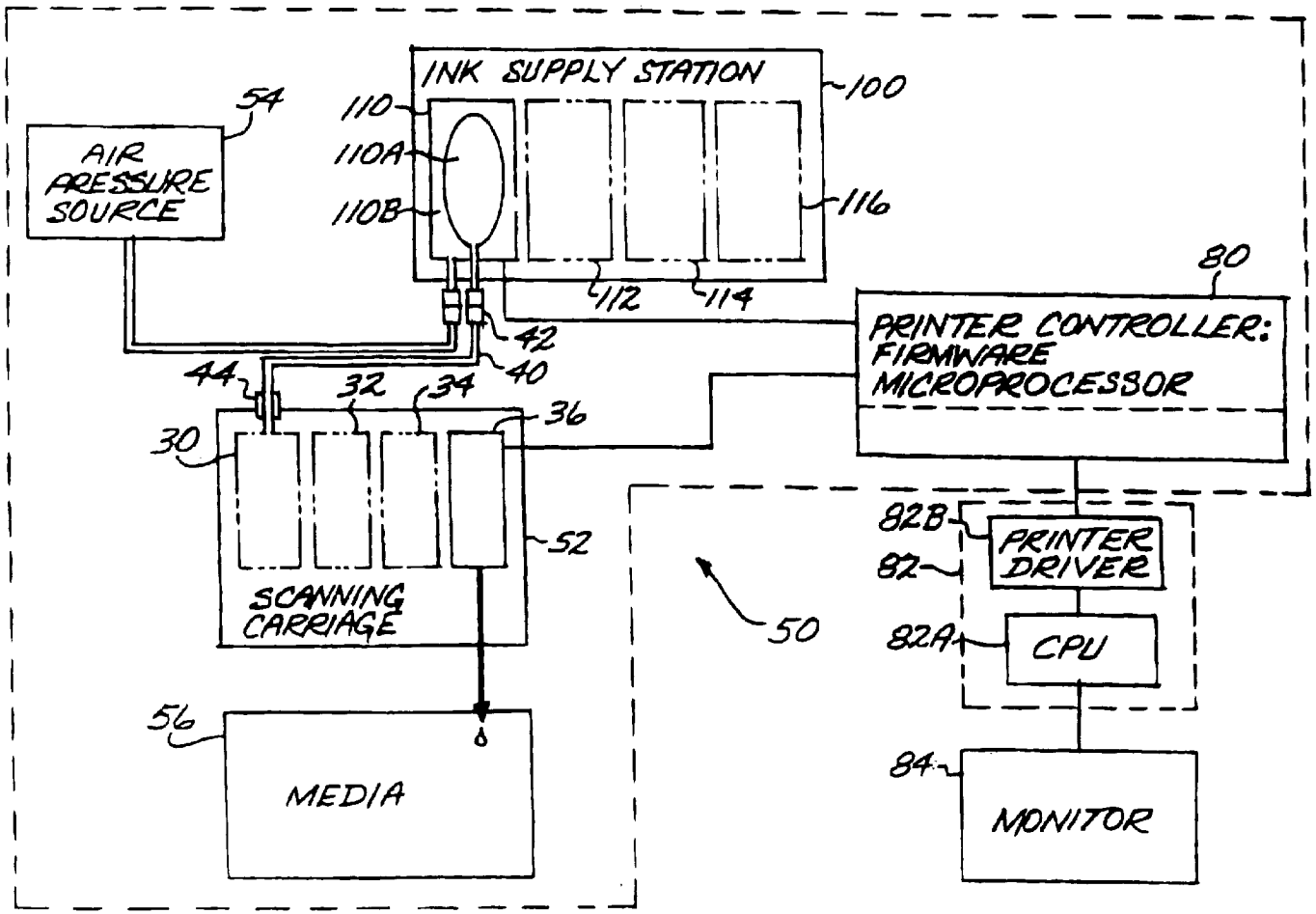
FIG. 1 is a schematic block diagram of an ink jet printer/plotter system which can utilize the invention.

In the following detailed description and in the several figures of the drawing, like elements are identified with like reference numerals.

Figure 2:
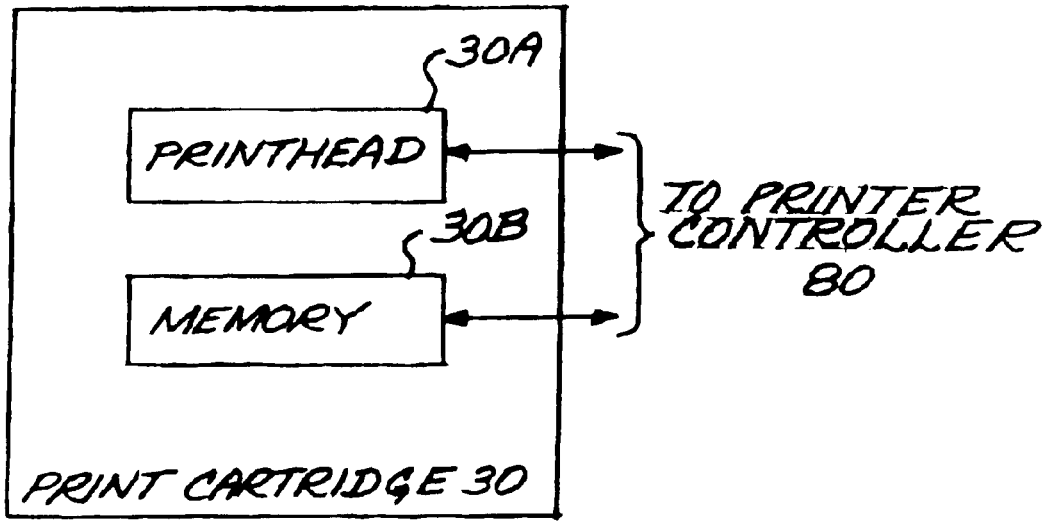
FIG. 2 is a schematic block diagram depicting major components of one of the print cartridges of the printer/plotter system of FIG. 1.

Referring now to FIG. 1, set forth therein is a schematic block diagram of a printer/plotter 50 in which the invention can be employed. A scanning print carriage 52 holds a plurality of print cartridges 30–36 which are fluidically coupled to an ink supply station 100 that supplies pressurized ink to the print cartridges 30–36. By way of illustrative example, each of the print cartridges 30–36 comprises an ink jet printhead and an integral printhead memory, as schematically depicted in FIG. 2 for the representative example of the print cartridge 30 which includes a thermal ink jet printhead 30A and an integral printhead non-volatile memory 30B. Each print cartridge has a fluidic regulator valve that opens and closes as ink is ejected to maintain a slight negative gauge pressure in the cartridge that is optimal for printhead performance. The ink provided to each of the cartridges 30–36 is pressurized to reduce the effects of dynamic pressure drops.

The ink supply station 100 contains receptacles or bays for accepting ink containers 110–116 which are respectively associated with and fluidically connected to respective print cartridges 30–36. Each of the ink containers 110–114 includes a collapsible ink reservoir, such as collapsible ink reservoir 110A that is surrounded by an air pressure chamber 110B. An air pressure source or pump 54 is in communication with the air pressure chamber for pressurizing the collapsible ink reservoir. For example, one pressure pump supplies pressurized air for all ink containers in the system. Pressurized ink is delivered to the print cartridges, e.g. cartridge 30, by an ink flow path such as flexible tubing 40 and fluid interconnects 42, 44 for respectively connecting ends of the tubing to the ink container 110 and the print cartridge 30.

In accordance with an aspect of the invention, ink having an air saturation of at least 30% (i.e., 30% or more) is delivered to the printhead of a print cartridge. As used herein, air saturation level is the percentage of dissolved (solubized) air in a liquid, compared to the maximum amount of air that can be dissolved in the liquid at a given temperature. As further examples, the ink delivered to the printhead has an air saturation level of at least 50% or 75%.

In an exemplary implementation, the ink container 110 contains ink having a relatively low air saturation such as 20% or less, and the tubing 40 is configured to allow diffusion of air to the ink in the tubing such that the ink delivered to the print cartridge is at least 30% air saturated. In other words, the tubing is configured to allow the ink to absorb air so that ink having an air saturation of at least 30% is delivered to the print cartridge. As further examples, the tubing allows the ink residing therein to absorb air so that ink having an air saturation of at least 50% or 75% is delivered to the print cartridge.

By way of specific example, the tubing 40 comprises low density polyethylene having an air permeability that allows sufficient diffusion of air such that ink residing in the tubing for about 24 hours will absorb sufficient air to provide an air saturation of at least 30% for an ink supply that has a relatively low level of air saturation such as 20% or less.

As discussed further herein, providing ink having sufficient air saturation reduces cavitation damage to heater resistors of the printhead that otherwise would be caused by bubble collapse.

The scanning print carriage 52, the print cartridges 30–36, and the ink containers 110–114 are more particularly electrically interconnected to a printer microprocessor controller 80 that includes printer electronics and firmware for the control of various printer functions. The controller 80 thus controls the scan carriage drive system and the printheads on the print carriage to selectively energize the printheads to cause ink droplets to be ejected in a controlled fashion on the print medium 56.

A host processor 82, which includes a CPU 82A and a software printer driver 82B, is connected to the printer controller 82. For example, the host processor 82 comprises a personal computer that is external to the printer 50. A monitor 84 is connected to the host processor 82 and is used to display various messages that are indicative of the state of the ink jet printer. Alternatively, the printer can be configured for stand-alone or networked operation wherein messages are displayed on a front panel of the printer.

Figure 3:
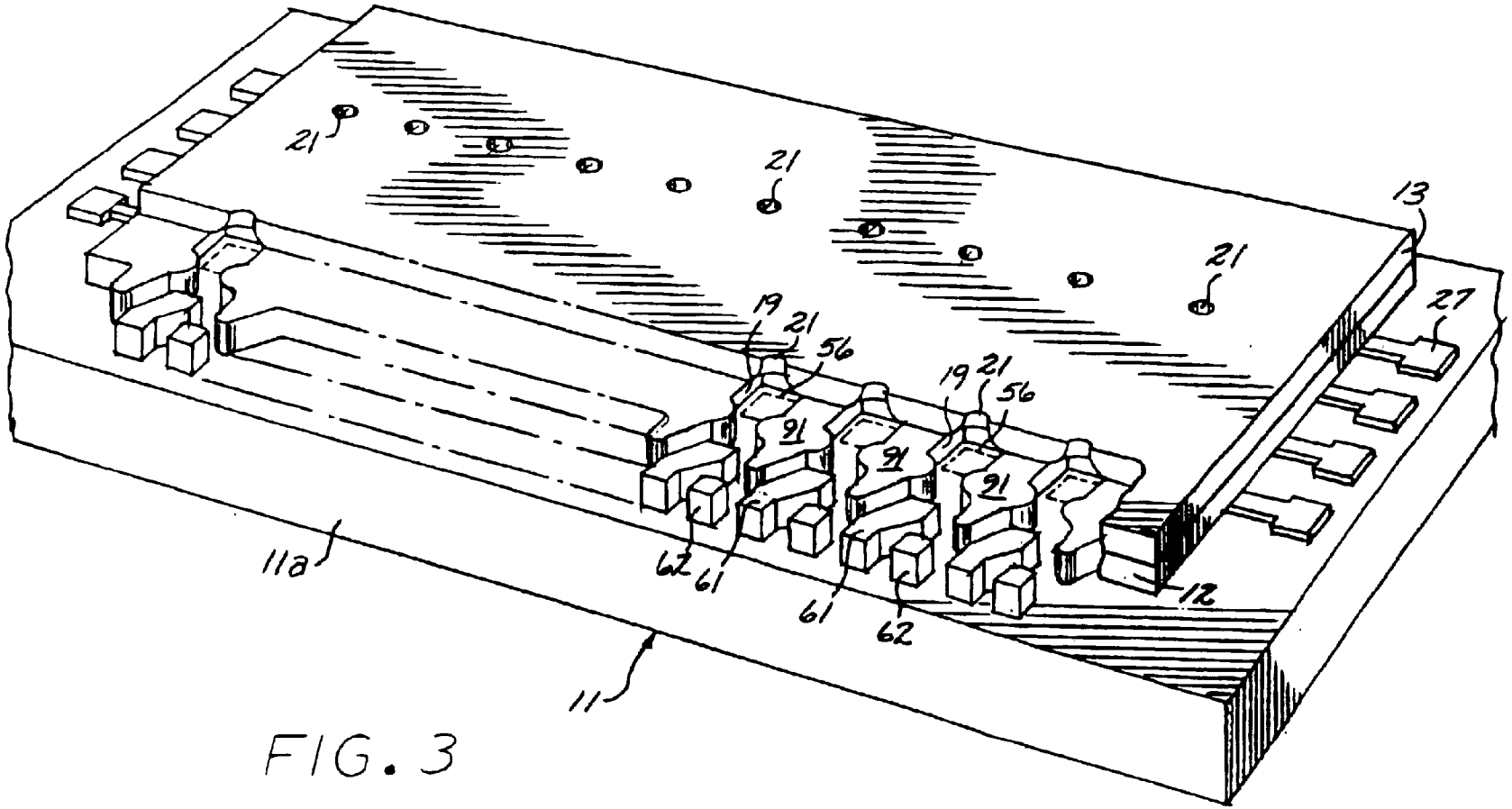
FIG. 3 is a schematic, partially sectioned perspective view of an ink jet printhead that can be used in the print cartridge of FIG. 2.

Referring now to FIG. 3, set forth therein is an unscaled schematic perspective view of an ink jet printhead with which the invention can be employed and which generally includes (a) a thin film substructure or die 11 comprising a substrate such as silicon and having various thin film layers formed thereon, (b) an ink barrier layer 12 disposed on the thin film substructure 11, and (c) an orifice or nozzle plate 13 attached to the top of the ink barrier 12.

The thin film substructure 11 is formed pursuant to integrated circuit fabrication techniques, and includes thin film heater resistors 56 formed therein. By way of illustrative example, the thin film heater resistors 56 are located in rows along longitudinal ink feed edges 11*a* of the thin film substructure 11.

The ink barrier layer 12 is formed of a dry film that is heat and pressure laminated to the thin film substructure 11 and photodefined to form therein ink chambers 19 and ink channels 29. Gold bond pads 27 engagable for external electrical connections are disposed at the ends of the thin film substructure 11 and are not covered by the ink barrier layer 12. By way of illustrative example, the barrier layer material comprises an acrylate based photopolymer dry film such as the Parad brand photopolymer dry film obtainable from E. I. duPont de Nemours and Company of Wilmington, Del. Similar dry films include other duPont products such as the "Riston" brand dry film and dry films made by other chemical providers. The orifice plate 13 comprises, for example, a planar substrate comprised of a polymer material and in which the orifices are formed by laser ablation, for example as disclosed in commonly assigned U.S. Pat. No. 5,469,199, incorporated herein by reference. The orifice plate can also comprise, by way of further example, a plated metal such as nickel.

The ink chambers 19 in the ink barrier layer 12 are more particularly disposed over respective ink firing resistors 56 formed in the thin film substructure 11, and each ink chamber 19 is defined by the edge or wall of a chamber opening formed in the barrier layer 12. The ink channels 29 are defined by further openings formed in the barrier layer 12, and are integrally joined to respective ink firing chambers 19. Elongated angled barrier islands 61 respectively associated with the ink channels and non-elongated barrier islands 62 are formed in the barrier layer 12 at alternating locations adjacent the ink feed edge 11*a*.

The orifice plate 13 includes orifices 21 disposed over respective ink chambers 19, such that an ink firing resistor 56, an associated ink chamber 19, and an associated orifice 21 form an ink drop generator. By way of illustrative example, each orifice 21 can be offset relative to the associated heater resistor 56, wherein the orifice is not centered on the heater resistor, as schematically depicted in FIG. 4.

Figure 4:
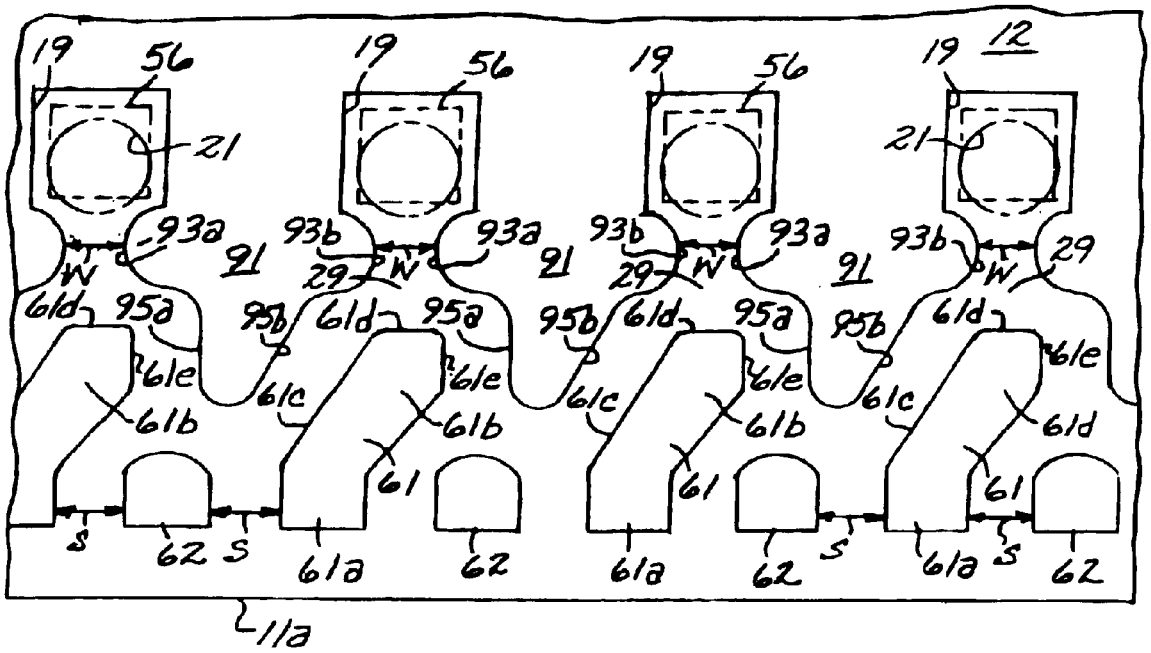
FIG. 4 is an unscaled schematic top plan view illustrating the configuration of a plurality of representative ink chambers, ink channels, and barrier islands of the printhead of FIG. 3.

FIG. 4 is an unscaled schematic top plan view illustrating the configuration of a plurality of representative ink chambers 19, associated ink channels 29, elongated angled barrier islands 61, and non-elongated barrier islands 62 of the printhead of FIG. 3.

Each ink channel 29 is formed by walls of barrier projections 91 that extend from regions between the ink chambers 19 toward the ink feed edge 11*a*. Each barrier projection 91 includes lobe walls 93*a*, 93*b* at the inlets to the ink chambers 19 that are on either side of a barrier projection, and tip walls 95*a*, 95*b* that extend from the lobe walls 93*a*, 93*b* toward the ink feed edge 11*a*. In this manner, the sides of an ink channel 29 are more particularly formed of opposing lobe walls 93*a*, 93*b* at the entrance to an ink chamber 19, and barrier tip walls 95*a*, 95*b* that extend from the lobe walls toward the feed edge 11*a*. By way of illustrative example, a first tip wall 95*a* is generally orthogonal to the ink feed edge while a second tip wall 95*b* diverges from the opposing first tip wall 95*a* with which it forms an ink channel. The second tip wall 95*b* is thus oblique relative to the ink feed edge 11*a*.

Each elongated angled barrier island 61 extends non-linearly from the ink feed edge 11*a* into the portion of the associated ink channel that is between the tip walls 95*a*, 95*b*. For example, the elongated barrier island comprises a first portion 61*a* adjacent the ink feed edge 11*a* and generally orthogonal to the ink feed edge, and a second portion 61*b* that is longer than the first portion 61*a* and forms an obtuse angle therewith so as to be oblique to the feed edge 11*a*. The longitudinal extent of the second portion 61*b* can be generally parallel to the associated second tip wall 95*b*.

By way of more specific example, the second portion 61*b* of an elongated angled barrier island is generally parallel to an adjacent second tip wall 95*c* and includes one side 61*c* that is generally parallel to the adjacent second tip wall 95*b*. The second portion 61*b* also includes a barrier island tip formed of a first side 61*d* that is generally orthogonal to the feed edge 11*a* and a second side 61*e* that is generally orthogonal to the first side 61*d* and generally parallel to the adjacent first tip wall 95*a*.

Generally, the second portion 61*b* of the elongated barrier island 61 extends into the ink channel obliquely so as to form an asymmetrical Y-shaped channel between the ends of the barrier tip walls and the inlet to the ink chamber.

Each of the non-elongated barrier islands 62 extends orthogonally from an ink feed edge 11*a*, and is similar in shape to the first portion 61*a* of the elongated barrier island 61. Each non-elongated barrier island is further located adjacent an associated barrier tip and displaced therefrom obliquely relative to the ink feed channel 11*a*. In this manner, the non-elongated barrier islands 62 and the elongated barrier islands 61 are alternatingly located along the ink feed edge 11*a*. The elongated angled barrier islands 61 and the non-elongated barrier islands 62 can be uniformly spaced along the ink feed edge 11*a*.

By way of specific example, the width of each of the non-elongated barrier islands 62 as measured along the extent of the ink feed edge 11*a* is substantially the same as the width of each of the first portions 61*a* of the elongated angled barrier islands 61*b*. Also, the length of each of the non-elongated barrier islands 62 as measured orthogonally to the extent of the ink feed edge 11*a* is substantially the same as the length of each of the first portions 61*a* of the elongated angled barrier islands 61*b*.

By way of further example, for preventing particles from reaching the inlets to the ink chambers, the spacing S between adjacent islands 61, 62 along the feed edge can be less than the width W of the "pinchpoint" which is narrowest region between opposing lobe walls 93*a*, 93*b* that form an inlet to an ink chamber.

By use of the invention, cavitation damage to the heater resistors 56 due to bubble collapse is reduced. When current flows through a heater resistor, it heats rapidly and heat flows to the ink in contact with it. In a short time, ink is vaporized, and a vapor bubble forms which propels unvaporized ink out of the nozzle. When the vapor bubble forms, any air dissolved in the ink prior to vaporization comes out of solution and remains in the vicinity of the heater resistor. When the bubble subsequently collapses due to condensation, ink rushes in to fill the void. The residual air provides a cushion for the in rushing of ink that otherwise would cause damage to the surface of the heater resistor that is adjacent the ink chamber. In this manner, the air that comes out of solution upon vaporization reduces cavitation damage to the heater resistor, and more dissolved air in the ink may be better.

Although the foregoing has been a description and illustration of specific embodiments of the invention, various modifications and changes thereto can be made by persons skilled in the art without departing from the scope and spirit of the invention as defined by the following claims.

What is claimed is:

1. An ink delivery system for an ink jet printer having a thermal ink jet printhead, comprising:

an ink container; and an ink conduit for transferring ink from said ink container to the printhead, said ink conduit configured to allow said ink to absorb air so that ink delivered to said printhead is at least 30% air saturated;

wherein said ink conduit allows said ink to become at least 30% air saturated pursuant to residence of said ink in said ink conduit of about 24 hours.

2. The ink delivery system of claim 1 wherein said ink conduit is configured to allow said ink to absorb air so that ink delivered to said printhead is at least 50% air saturated.

3. The ink delivery system of claim 1 wherein said ink conduit is configured to allow said ink to absorb air so that ink delivered to said printhead is at least 75% air saturated.

4. The ink delivery system of claim 1 wherein said ink conduit comprises flexible tubing.

5. The ink delivery system of claim 4 wherein said flexible tubing comprises low density polyethylene.

6. An ink delivery system for an ink jet printer having a thermal ink jet printhead, comprising:

an ink container containing a supply of ink having an air saturation level of 20% or less; and an ink conduit for transferring ink from said ink container to the printhead, said ink conduit configured to allow said ink to absorb air so that ink delivered to said printhead is at least 30% air saturated.

7. The ink delivery system of claim 6 wherein said ink conduit allows said ink to become at least 30% air saturated pursuant to residence of said ink in said ink conduit of about 24 hours.

8. The ink delivery system of claim 7 wherein said ink conduit comprises flexible tubing.

9. The ink delivery system of claim 8 wherein said flexible tubing comprises low density polyethylene.

10. The ink delivery system of claim 6 wherein said ink conduit is configured to allow said ink to absorb air so that ink delivered to said printhead is at least 50% air saturated.

11. The ink delivery system of claim 6 wherein said ink conduit is configured to allow said ink to absorb air so that ink delivered to said printhead is at least 75% air saturated.

12. An ink jet printing system comprising:

a print cartridge having an ink jet printhead;

said printhead having heater resistors, ink chambers disposed over said heater resistors, and nozzles offset relative to said heater resistors;

an ink container; and an ink conduit for transferring ink from said ink container to said print cartridge, said ink conduit configured to allow said ink to absorb air so that ink delivered to said printhead is at least 30% air saturated;

wherein said ink conduit allows said ink to become at least 30% air saturated pursuant to residence of said ink in said ink conduit of about 24 hours.

13. The ink jet printing system of claim 12 wherein said ink conduit is configured to allow said ink to absorb air so that ink delivered to said printhead is at least 50% air saturated.

14. The ink jet printing system of claim 12 wherein said ink conduit is configured to allow said ink to absorb air so that ink delivered to said printhead is at least 75% air saturated.

15. The ink jet printing system of claim 12 wherein said ink conduit comprises flexible tubing.

16. The ink jet printing system of claim 15 wherein said flexible tubing comprises low density polyethylene.

17. A method of printing comprising:

providing an ink supply for holding a supply of liquid ink having an air saturation level of 20% or less;

transferring ink from the ink supply to an ink jet print cartridge having a thermal ink jet printhead; and while transferring ink from the ink supply, allowing air to be absorbed into the ink such that the ink jet printhead receives ink that is at least 30% air saturated.

18. The method of claim 17 wherein allowing air to be absorbed comprises allowing air to be absorbed into the ink over a period of about 24 hours such that the thermal ink jet printhead receives ink that is at least 30% air saturated.

19. The method of claim 17 wherein allowing air to be absorbed comprises allowing air to be absorbed into the ink such that the thermal ink jet printhead receives ink that is at least 50% air saturated.

20. The method of claim 17 wherein allowing air to be absorbed comprises allowing air to be absorbed into the ink such that the thermal ink jet printhead receives ink that is at least 75% air saturated.

21. The method of claim 17 wherein transferring ink comprises conveying the ink through flexible tubing.

22. The method of claim 17, wherein allowing air to be absorbed into the ink comprises allowing air to be absorbed through an air permeable ink conduit.

23. The method of claim 22, wherein the ink conduit comprises flexible tubing.

24. The method of claim 23, wherein the flexible tubing comprises low density polyethylene.

25. A method of printing comprising:

transferring ink from an ink supply to an ink jet print cartridge having a thermal ink jet printhead; and while transferring ink from the ink supply, allowing air to be absorbed into the ink such that the print cartridge receives ink that is at least 30% air saturated;

wherein allowing air to be absorbed comprises allowing air to be absorbed into the ink over a period of about 24 hours such that the ink jet print cartridge receives ink that is at least 30% air saturated.

26. The method of claim 25 wherein allowing air to be absorbed comprises allowing air to be absorbed into the ink such that the ink jet print cartridge receives ink that is at least 50% air saturated.

27. The method of claim 25 wherein allowing air to be absorbed comprises allowing air to be absorbed into the ink such that the ink jet print cartridge receives ink that is at least 75% air saturated.

28. The method of claim 25 transferring ink comprises conveying the ink through flexible tubing.

29. A method for extending the life of a heater resistor in a thermal ink jet printhead of a print cartridge, comprising:

transferring ink from an ink container to the print cartridge via an ink conduit and delivering said ink to the printhead, the ink conduit being configured to allow the ink to absorb air so that ink delivered to said printhead is at least 30% saturated.

30. The method of claim 29 wherein said ink conduit allows said ink to become at least 30% air saturated pursuant to residence of said ink in said ink conduit in about 24 hours.

31. The method of claim 29 wherein said ink conduit is configured to allow said ink to absorb air so that ink delivered to said printhead is at least 50% air saturated.

32. The method of claim 29 wherein said ink conduit is configured to allow said ink to absorb air so that ink delivered to said printhead is at least 75% air saturated.

33. The method of claim 29 wherein said ink conduit comprises flexible tubing.

34. The method of claim 33 wherein said flexible tubing comprises low density polyethylene.

35. The method of claim 29 wherein the ink container contains a supply of ink having an air saturation level of 20% or less.

36. The method of claim 35 wherein said ink conduit allows said ink to become at least 30% air saturated pursuant to residence of said ink in said ink conduit of about 24 hours.

37. The method of claim 35 wherein said ink conduit is configured to allow said ink to absorb air so that ink delivered to said printhead is at least 50% air saturated.

38. The method of claim 35 wherein said ink conduit is configured to allow said ink to absorb air so that ink delivered to said printhead is at least 75% air saturated.

39. The method of claim 35 wherein said ink conduit comprises flexible tubing.

40. The method of claim 39 wherein said flexible tubing comprises low density polyethylene.

41. The method of claim 29, wherein the ink conduit being configured to allow the ink to absorb air comprises the ink conduit having an air permeability allowing the ink to absorb air through the ink conduit.

42. A method for extending the life of a heater resistor in a thermal ink jet printhead of a print cartridge, comprising:

transferring ink from an ink container to the print cartridge via an ink conduit; and delivering said ink to the printhead, the ink conduit being configured to allow the ink to absorb air so that ink delivered to said printhead is at least 30% saturated; and firing the heater resistor to eject droplets of ink from the printhead, wherein the air absorbed in the ink reduces cavitation damage to the heater.

43. The method of claim 42 wherein said ink conduit allows said ink to become at least 30% air saturated pursuant to residence of said ink in said ink conduit of about 24 hours.

44. The method of claim 42 wherein said ink conduit is configured to allow said ink to absorb air so that ink delivered to said printhead is at least 50% air saturated.

45. The method of claim 42 wherein said ink conduit is configured to allow said ink to absorb air so that ink delivered to said printhead is at least 75% air saturated.

46. The method of claim 42 wherein said ink conduit comprises flexible tubing.

47. The method of claim 46 wherein said flexible tubing comprises low density polyethylene.

48. An ink delivery system for an ink jet printer having a thermal ink jet printhead, comprising:

an ink container with a pressurized ink reservoir; and an ink conduit for transferring pressurized ink from said ink container to the print cartridge, said ink conduit configured to allow said ink to absorb air so that ink delivered to said printhead is at least 30% air saturated.

49. The ink delivery system of claim 48 wherein said ink conduit allows said ink to become at least 30% air saturated pursuant to residence of said ink in said ink conduit of about 24 hours.

50. The ink delivery system of claim 48 wherein said ink conduit is configured to allow said ink to absorb air so that ink delivered to said printhead is at least 50% air saturated.

51. The ink delivery system of claim 48 wherein said ink conduit is configured to allow said ink to absorb air so that ink delivered to said printhead is at least 75% air saturated.

52. The ink delivery system of claim 48 wherein said ink conduit comprises flexible tubing.

53. The ink delivery system of claim 52 wherein said flexible tubing comprises low density polyethylene.

* * * * *